US005094150A

United States Patent [19]

Russner et al.

[11] Patent Number: 5,094,150

[45] Date of Patent: Mar. 10, 1992

[54] PUMP PISTON FOR AXIAL PISTON PUMPS

[75] Inventors: Klaus Russner, Lauf; Volker Dietrich, Röthenbach; Gerd Meier, Leinburg, all of Fed. Rep. of Germany

[73] Assignee: Hoechst CeramTec Aktiengesellschaft, Selb, Fed. Rep. of Germany

[21] Appl. No.: 507,199

[22] Filed: Apr. 10, 1990

[30] Foreign Application Priority Data

Apr. 29, 1989 [DE] Fed. Rep. of Germany ..... 3914333

[51] Int. Cl.[5] ..... F16J 9/00

[52] U.S. Cl. ..... 92/248; 92/261; 92/172; 228/122; 403/272

[58] Field of Search ..... 92/172, 222, 231, 260, 92/248; 228/122, 246; 403/272, 271, 404; 416/241 B

[56] References Cited

U.S. PATENT DOCUMENTS

| | | | |
|---|---|---|---|
| 3,302,961 | 2/1967 | Franklin | 403/272 |
| 3,402,645 | 9/1968 | Nelson | 92/222 |
| 4,167,351 | 9/1979 | Bindin | 403/404 |
| 4,225,262 | 9/1980 | Koop et al. | 403/272 |
| 4,325,647 | 4/1982 | Maier et al. | 403/404 |
| 4,557,704 | 12/1985 | Ito et al. | 416/241 B |
| 4,568,586 | 2/1986 | Gobrecht | 403/271 |
| 4,591,401 | 5/1986 | Neidig et al. | 228/122 |
| 4,604,945 | 8/1986 | Mizuhara | 92/260 |
| 4,699,310 | 10/1987 | Kohno et al. | 228/122 |
| 4,722,632 | 2/1988 | Campbell | 403/272 |
| 4,741,254 | 5/1988 | Taylor | 92/248 |
| 4,819,857 | 4/1989 | Mizuishi et al. | 228/246 |
| 4,857,411 | 8/1989 | Yamaguchi et al. | 228/122 |
| 4,890,783 | 1/1990 | Li | 228/122 |
| 4,917,642 | 4/1990 | Nakahashi et al. | 228/122 |

FOREIGN PATENT DOCUMENTS

| | | | |
|---|---|---|---|
| 3238667 | 4/1984 | Fed. Rep. of Germany | 92/222 |
| 1215908 | 3/1986 | U.S.S.R. | 228/122 |
| 979811 | 1/1965 | United Kingdom | 228/122 |

*Primary Examiner*—Edward K. Look
*Assistant Examiner*—Thomas Denion
*Attorney, Agent, or Firm*—Foley & Lardner

[57] ABSTRACT

In the pump piston for axial piston pumps which comprises a ceramic piston and a drive member of metallic material the ceramic piston has an end face of which from 20 to 80% is in the form of a joint surface for a soldered connection to the drive member.

14 Claims, 1 Drawing Sheet

PUMP PISTON FOR AXIAL PISTON PUMPS

DESCRIPTION

Figure 1:
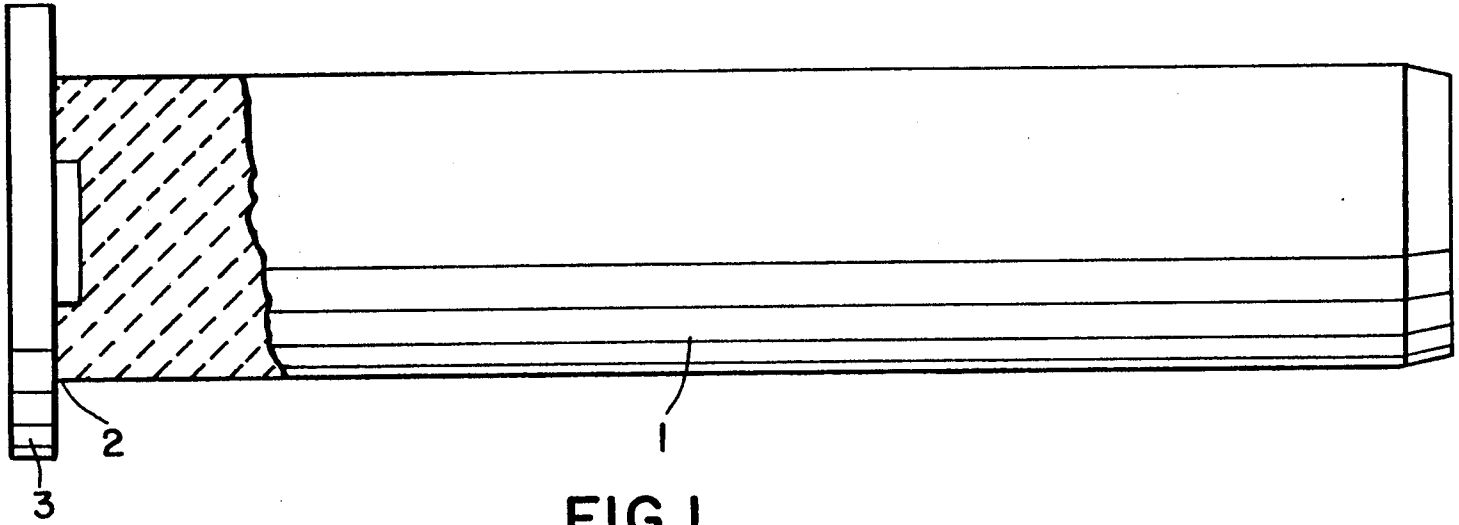

The invention relates to a pump piston for axial piston pumps, which consists of a ceramic piston and a drive member of metallic material.

Frictional connections, positive connections and unions of materials are known between ceramic and metallic have various disadvantages. Thus, the adhesives which can be used here are subject to ageing, which results in embrittlement of the connection. The use of adhesive connections is limited because organic adhesives are decomposed at higher temperatures. In some cases adhesive connections also cannot be used because of their poor resistance to some chemicals. Force fit or shrunk connections also cannot be used because of settlement. Positive connections have the disadvantage that geometrically complicated parts mush be made with very great precision. The manufacture of ceramic components is in particular made difficult by this requirement.

For the union of materials the ceramic material is metallized with a molybdenum-manganese mixture or with tungsten and then, in another operation, joined by means of suitable solders to one or more metal partners. Direct soldering not preceded by metallization is also known. For this purpose, however, solders having titanium, zirconium or hafnium contents must be used. For the purpose of reducing the tensions which occur between the metal and the ceramic material, and which are caused by different coefficients of expansion, it is nevertheless necessary to use metals whose expansion behavior is adapted to the ceramic material; otherwise, special constructions also leading to a reduction of tension are used. These constructions, however, tolerate only light mechanical stressing.

The shortcomings indicated above are overcome by means of a pump piston wherein the ceramic piston has an end face of which from 20 to 80%, more particularly from 25 to 60% is in the form of a joint surface for a soldered connection to the drive member.

For this purpose it is immaterial which parts of the end face are in the form of a joint surface. Separate individual regions or annular regions of the end face are equally suitable for the purpose, and such regions may be areas raised or set back relative to the end face. The ceramic-to-metal connection may be made by active or passive soldering. Solders containing titanium, zirconium, hafnium and the like are suitable for the first of these methods, while suitable solders for the second method are those based on precious metals, copper or alloys thereof, or those based on lead, tin, zinc or their alloys. The joint openings may be smaller than 500 μm. In the case of passive soldering the joint surface must be metallized, for which purpose molybdenum, molybdenum-manganese or tungsten are suitable. In order to improve the wetting for the solder, the metallized surfaces may be coated with nickel. The ceramic piston may consist of an aluminum oxide having $Al_2O_3$ contents between 80 and 100%, or of silicon carbide; the drive part may be composed of ferrous or nonferrous metals, such as alloyed or unalloyed steel, austenite, brass, copper, titanium or the like.

Figure 2:
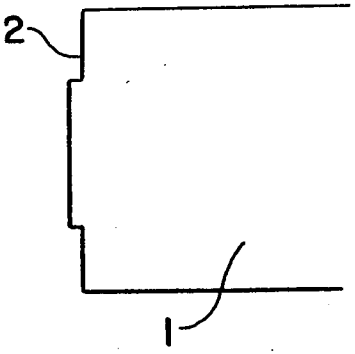

The drawing in FIG. 1 shows a pump piston, in which the ceramic piston (1), shown partly in section, is joined by soldering to the metallic drive part (3). The joint surface or soldering surface (2) is in the form of a ring in this example. FIG. 2 shows an embodiment of the invention in which joint surface (2) of ceramic piston (1) is set back.

The adhesive strength of the soldered joint in dependence on the size of the joint surface can be seen from the Table. All tests were carried out on soldered joints between steel disks (ST 52) of a diameter of 27 mm and a thickness of 3 mm and ceramic (alumina) pistons of a diameter of 20 mm.

TABLE

| Test | Type of joint | Joint surface: Outside diameter mm | Joint surface: Inside diameter mm | Tear-off force N |
|---|---|---|---|---|
| 1 | metallized + soldered | 20 | 0 | 1965 |
| 2 | | 20 | 10 | 3435 |
| 3 | | 20 | 15 | 8035 |
| 4 | Active soldered | 20 | 0 | 1318 |
| 5 | | 20 | 10 | 1604 |
| 6 | | 20 | 15 | 5910 |

We claim:

1. A pump piston for axial piston pumps, comprising:
a ceramic piston having a shaft diameter; and
a drive member of metallic material having a diameter greater than the shaft diameter,
wherein the ceramic piston has an end face directly opposing a surface of the drive member and from 20 to 80% of the ceramic piston end face is in the form of a joint surface for a soldered connection to the drive member.

2. A pump piston as claimed in claim 1, wherein from 25 to 60% of the end face is in the form of a joint surface.

3. A pump piston as claimed in claim 1, wherein separate individual regions of the end face of the ceramic piston are in the form of a joint surface.

4. A pump piston as claimed in claim 1, wherein an annular region of the end face is in the form of a joint surface.

5. A pump piston as claimed in claim 1, wherein the end face of the ceramic piston has an integral joint surface which is elevated relative to the non-joint surface portion of the end face.

6. A pump piston as claimed in claim 1, wherein the end face of the ceramic piston has an integral joint surface which is recessed relative to the non-joint surface portion of the end face.

7. A pump piston as claimed in claim 1, wherein the joint surface is metallized.

8. A pump piston as claimed in claim 1, wherein at least one void exists between the ceramic piston end face and the surface of the drive member opposing the end face.

9. A pump piston as claimed in claim 4, further comprising at least one void enclosed by the ceramic piston end face, the surface of the drive member and the soldered connection.

10. A pump piston as claimed in claim 1, wherein the ceramic piston end face is provided with a discontinuous surface.

11. A pump piston as claimed in claim 8, wherein the void has a length less than 10% of the shaft diameter.

12. A pump piston as claimed in claim 9, wherein the void has a length less than 10% of the shaft diameter.

13. A pump piston as claimed in claim 1, wherein the drive member diameter is 35% greater than the shaft diameter.

14. A pump piston as claimed in claim 1, wherein from 20 to 25% of the end face is in the form of a joint surface.

* * * * *